US006052947A

United States Patent [19]

Smith

[11] Patent Number: 6,052,947

[45] **Date of Patent: *Apr. 25, 2000**

[54] WINDOW REGULATOR MECHANISM HAVING COUNTERBALANCING MEMBER

[75] Inventor: Peter J. Smith, Newmarket, Canada

[73] Assignee: Atoma International Corp., Newmarket, Canada

[ * ] Notice: This patent is subject to a terminal disclaimer.

[21] Appl. No.: 09/073,355

[22] Filed: May 6, 1998

Related U.S. Application Data

[60] Provisional application No. 60/045,698, May 6, 1997.

[51] Int. Cl.[7] ..... E05F 11/48

[52] U.S. Cl. ..... 49/352; 49/374

[58] Field of Search ..... 49/428, 429, 348, 49/349, 350, 351, 352, 358, 377, 445, 446, 502, 374

[56] References Cited

U.S. PATENT DOCUMENTS

| | | | |
|---|---|---|---|
| 1,461,277 | 7/1923 | Leidgen | 49/348 |
| 1,535,987 | 4/1925 | Clas | 49/351 |
| 1,557,150 | 10/1925 | Forgerson | 49/353 |
| 1,617,195 | 2/1927 | Bourgon | 49/350 |
| 1,622,603 | 3/1927 | Nicholson | 49/350 |
| 1,651,003 | 11/1927 | Tichenor et al. | 49/352 |
| 1,710,220 | 4/1929 | Maise | 49/350 |
| 2,276,512 | 3/1942 | Parsons | 49/350 |
| 2,657,925 | 11/1953 | Crow | 49/352 |
| 4,001,971 | 1/1977 | Gobush et al. | 49/352 |
| 4,117,568 | 10/1978 | Bullock . | |
| 4,400,913 | 8/1983 | Krantz et al. . | |
| 4,502,247 | 3/1985 | Kobayashi et al. . | |
| 4,837,976 | 6/1989 | Westfall et al. . | |
| 4,854,558 | 8/1989 | Newton . | |
| 4,882,805 | 11/1989 | Campbell et al. . | |
| 4,970,827 | 11/1990 | Djordjevic | 49/349 |
| 5,201,144 | 4/1993 | Krajenke . | |
| 5,205,074 | 4/1993 | Guhl et al. . | |
| 5,267,416 | 12/1993 | Davis . | |
| 5,469,663 | 11/1995 | Tenbrink et al. . | |

FOREIGN PATENT DOCUMENTS

| | | |
|---|---|---|
| 2 704 267 | 10/1994 | France . |
| 735 400 | 5/1943 | Germany . |
| 819614 | 9/1959 | United Kingdom . |

*Primary Examiner*—Daniel P. Stodola
*Assistant Examiner*—Curtis A. Cohen
*Attorney, Agent, or Firm*—Pillsbury Madison & Sutro LLP

[57] ABSTRACT

A window regulator mechanism comprises an elongated guide rail member mounted within a vehicle door. A window moving structure engages the window panel and is slidably mounted on the guide rail member to allow the window panel to be moved generally vertically with respect to the vehicle door. An actuating mechanism slidably moves the window moving structure along the guide rail member. An elongated, flexible counterbalancing member applies a counterbalancing force to the window panel that opposes a force of gravity acting on the window panel. The counterbalancing member has a first end attached within the door, a second end attached to the window moving structure, and an intermediate portion extending over a guiding portion disposed above an uppermost position of the window moving structure. The counterbalancing member is formed from an elastomeric material and is elastically deformed to an initial deformed state when the window moving structure is in its uppermost position, and elastically deforms beyond its initial deformed state as the window panel moves downwardly with respect to the vehicle door to thereby oppose the force of gravity acting on the window panel and provide a controlled, downward movement of the window panel. The counterbalancing member resiliently applies the counterbalancing force to oppose the force of gravity acting on the window panel as the window panel moves upwardly to thereby facilitate upward movement of the window panel.

17 Claims, 5 Drawing Sheets

WINDOW REGULATOR MECHANISM HAVING COUNTERBALANCING MEMBER

This application claims the benefit of U.S. Provisional Application No. 60/045,698, filed May 6, 1997.

BACKGROUND OF THE INVENTION

The present invention relates to window regulator mechanisms and, more particularly, to a counterbalancing member for a window regulator mechanism.

Conventional window regulator mechanisms have a guide rail member with a slider member slidably mounted thereon. The slider member is attached to a lifter plate which is engaged with the window. A pair of wires extend in opposite vertical directions from the slider member and are wound around a driven drum. The drum is rotated by means of a crank handle or electric motor in order to raise and lower the window. Typically, a counterbalancing mechanism is used in order to facilitate upward movement of the window and control downward movement. A counterbalancing mechanism is especially effective when used in conjunction with a crank handle in order to reduce the amount of torque that one must apply to the handle in order to raise the window and to effectively maintain a controlled cranking motion of the handle as the window is lowered.

The typical counterbalancing mechanism utilizes a coil spring made of steel or other metal. The spring is usually fixed to an upper portion of the guide rail member and to either the lifter plate or slider member. These springs, however, can become weakened over time due to corrosion. Also, metallic springs are typically designed to be used in one particular regulator mechanism and oftentimes cannot be used if certain parameters, such as the distance between the uppermost and lowermost position of the slider member, are altered. In addition, it is always desirable to reduce the costs of mechanisms used in the automotive industry and, accordingly, there is a desire to find a relatively less expensive alternative to metal coil springs.

It is therefore an object of the present invention to obviate the problems associated with the metal coil springs conventionally used in counterbalancing mechanisms. It is also an object of the present invention to provide a relatively inexpensive alternative to metal coil springs. The present invention is a window regulator mechanism for generally vertically moving a window panel mounted within a motor vehicle door. The mechanism comprises an elongated guide rail member mounted within the vehicle door and extending longitudinally in a generally vertical direction.

A window moving structure engages the window panel. The window moving structure is slidably mounted on the guide rail member to allow the window panel to be moved generally vertically with respect to the vehicle door. A manually operated actuating mechanism is constructed and arranged to slidably move the window moving structure along the guide rail member so that the window panel is moved generally vertically with respect to the vehicle door.

An elongated, flexible counterbalancing member is constructed and arranged to apply a counterbalancing force to the window panel that opposes a force of gravity acting on the window panel. The counterbalancing member has a first end fixedly attached within the motor vehicle door, a second end fixedly attached to the window moving structure, and an intermediate portion extending over a guiding portion disposed above an uppermost position of the window moving structure so that portions of the counterbalancing member extend downwardly therefrom to the fixedly attached ends.

The counterbalancing member is formed from a flexible elastomeric material and is elastically deformed to an initial elastically deformed state when the window moving structure is in its uppermost position. The counterbalancing member is configured to elastically deform beyond its initial elastically deformed state as the window panel moves downwardly with respect to the vehicle door against the counterbalancing force of the counterbalancing member to thereby oppose the force of gravity acting on the window panel and thereby provide a controlled, downward movement of the window panel. The counterbalancing member resiliently returns to its initial elastically deformed state as the window panel moves upwardly with respect to the vehicle door. The counterbalancing member applies the counterbalancing force to oppose the force of gravity acting on the window panel as the window panel moves upwardly to thereby facilitate upward movement of the window panel.

Other objects, features and characteristics of the present invention, as well as the method of operation and function of the related elements of the structure, and the combination of the parts and economics of manufacture, will become more apparent upon consideration of the following detailed description and appended claims with reference to the accompanying drawings, all of which form a part of this specification.

DETAILED DESCRIPTION OF THE PREFERRED EMBODIMENT

Figure 1:
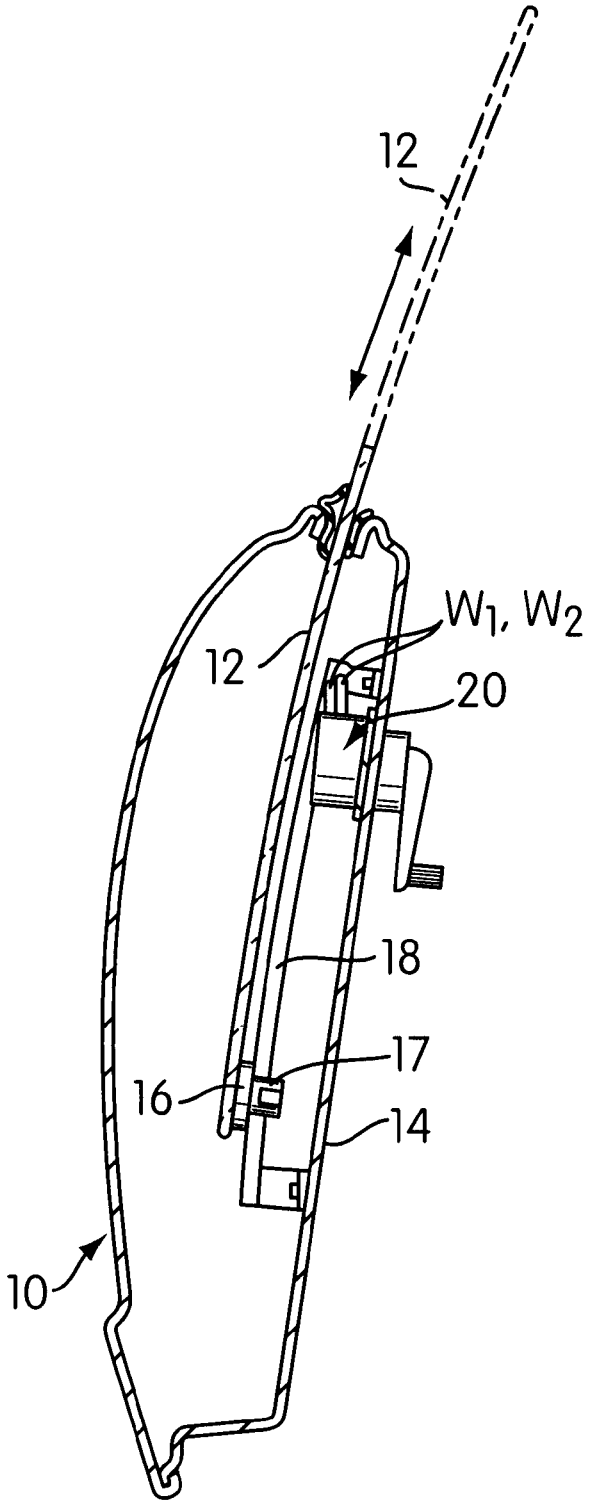
FIG. 1 is a sectional view of a window regular mechanism embodying the principles of the present invention shown as incorporated in an automotive vehicle door structure.

In FIG. 1, the window regulator mechanism is shown as incorporated in an automotive vehicle door structure 10 for operating a vertically movable window panel 12. The door structure comprises an inner panel 14 formed at its lower portion with a terminal flange over which the marginal portion of an outer panel is crimped to provide an integral structure having a space or well between the inner and outer panels. The window well has a slot or access opening through which the window panel 12 is slidably moved into and out of the well by the window regulator mechanism positioned at the inner side of the path of travel of the window panel 12. The window regulator mechanism includes a lifter plate 16 engaging the lower portion of the window panel 12. A slider member 17 is secured to the lifter plate 16 and mounted for sliding movement along a longitudinal guide rail member 18 bolted on the inner panel 14. Together the slider member 17 and the lifter plate 16 constitute a window moving structure. The guide rail member 18 is preferably steel or aluminum and formed by stamping. An actuating mechanism in the form of a drive unit 20 is mounted on the inner panel to aid in unwinding one of two wires W1 and W2 and retracting the other wire so as to vertically move the lifter plate 16 and window panel 12.

Figure 2:
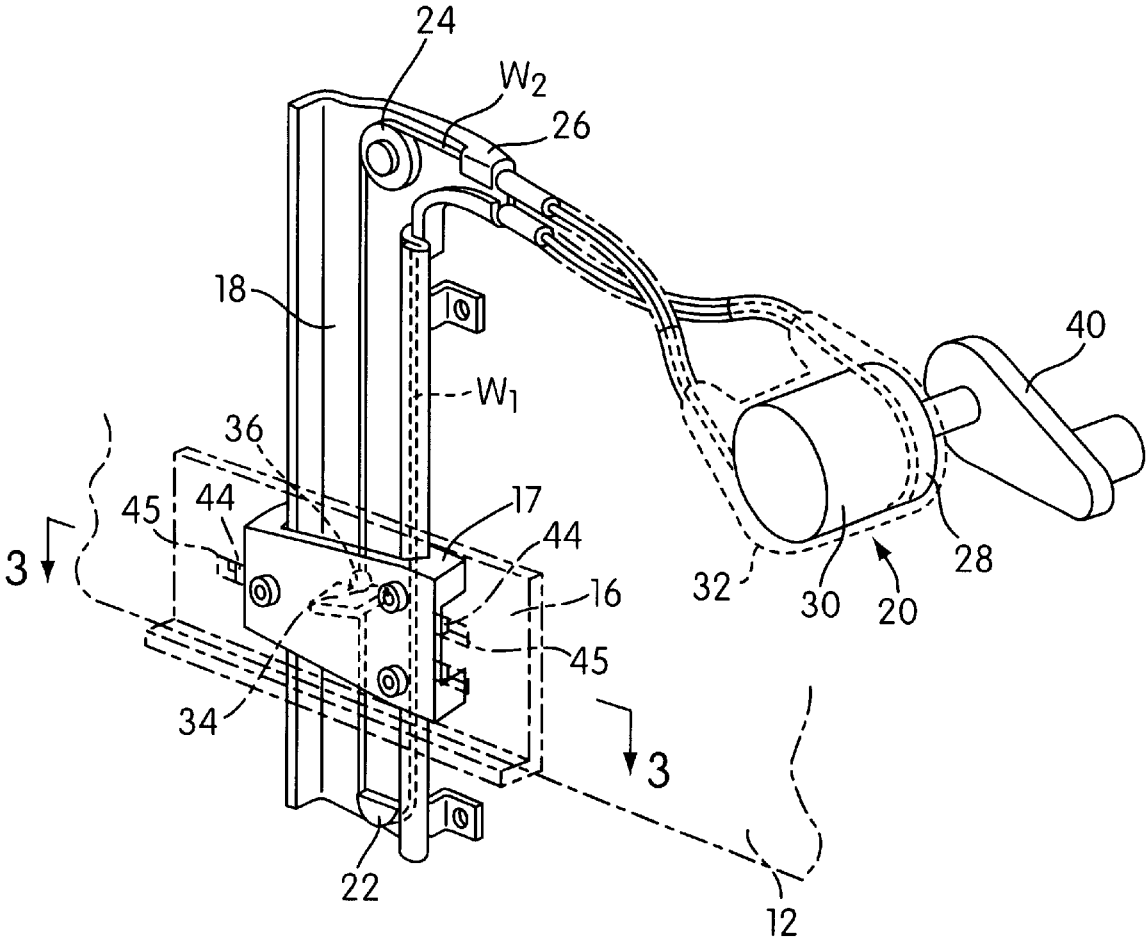
FIG. 2 is a schematic perspective view of the window regulator mechanism of FIG. 1 in combination with a lift plate slider assembly.

Referring to FIG. 2, the guide rail member 18 has at its lower end a semi-circular guide plate 22 secured thereon for guiding the wire W1 and at its upper end a guide pulley 24 secured rotatably thereon for guiding the wire W2. The vertically spaced-apart guide plate 22 and pulley 24 can be referred to as guiding portions and constitute the limits of movement of the lifter plate 16. The guide plate 18 also has a guide opening 26 for guiding the wires W1 and W2 toward the drive unit 20 which is shown schematically as including drive and driven drums 28 and 30 housed within a casing 32. The drive drum 28 can be driven in response to manual operation in a conventional fashion by a window crank handle 40 or by an electrically powered motor.

The slider member 17 has a nipple housing member 34 constructed and arranged to fixedly attach wire beads 36 fixed to the wire or cable W2. This enables the slider member 17 to be slidably driven along guide rail member 18 upon movement of wires W1, W2. The wire W1 extends downward from the nipple housing 34 to the semi-circular guide plate 22 around which it extends upward to the pulley 24 and through guide opening 26 and then through a guide tube to the drive drum 28. The wire W2 extends upward from the nipple housing 34 to the guide pulley 24 around which it extends to the guide opening 26 and then through a guide tube to the driven drum 30. The driven drum 28 rotates in a first or second rotational direction with rotation of the crank handle 40 in a conventional fashion to drive the driven drum 28 and effect movement of the wires W1, W2 through the guide tubes. This in turn causes upwards or downwards vertical movement of the slider member 17 along the guide rail member 18 depending on the direction in which the crank handle 40 is rotated.

Figure 3:
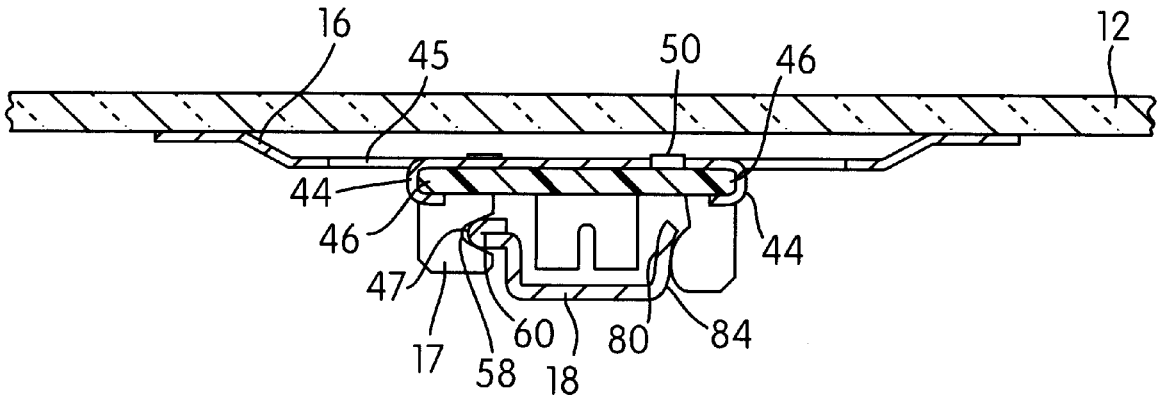
FIG. 3 is a cross-sectional view taken through the line 3—3 in FIG. 2.

Turning now to FIG. 3 there is shown a cross-sectional view of the lifter plate 16, the slider member 17, and the steel guide rail member 18 onto which the slider member 17 is slidably mounted.

The lifter plate 16 is secured to the window panel 12 in conventional fashion. The lifter plate 16 has tab members 44 punched through the metal material thereof, which forms openings 45 in the remaining portions of the lifter plate 16. The tab members 44 are crimped around opposite edges 46 defined by a surface extending between leg portions 48 of the slider member 17 (see FIG. 4).

The slider member 17 is molded from a plastic material. It is also provided with a plurality (3) of locating projections 50 constructed and arranged to be received to be received in corresponding holes in the lifter plate 16 for proper alignment between the slider member 17 and the lifter plate 16 with the window panel 12 attached thereto.

Figure 4:
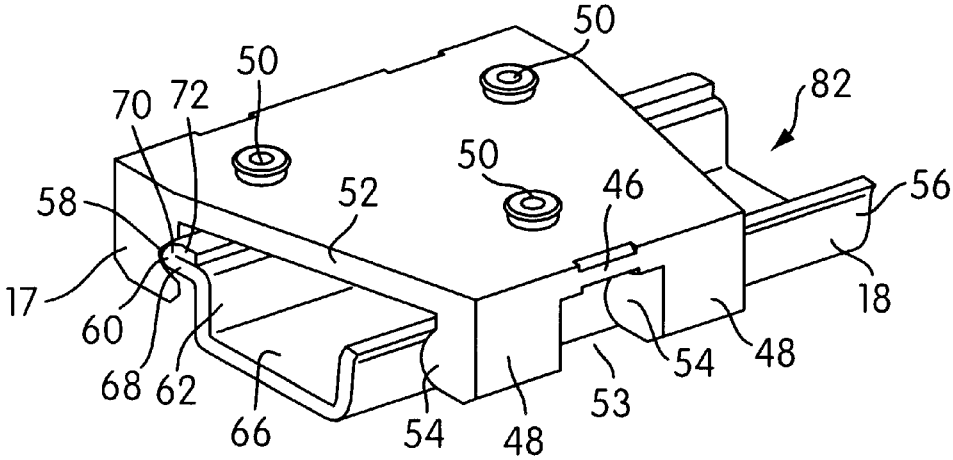
FIG. 4 is a perspective view showing the wedge slider member and a portion of the rail channel in accordance with the principles of the present invention.

It can be appreciated that from FIG. 4 that the slider member 17 has a plate-like base portion 52 having a generally quadrilateral configuration. Four leg portions 48 extend generally from the corners of the base portion 52 and define a recess 53 therebetween in which the tab members 44 are received for fixing the lifter plate 16 to the wedge slider body 17. The leg portions 48 of the slider body 17 located on one side of the base portion 52 are provided with inwardly projecting portions 54 which are particularly constructed and arranged to slidably engage the convex exterior surface 84 of a side flange portion 56 of the guide rail member 18. The opposite leg portions 48 disposed on an opposite side of the base portion 52 are provided with "V"-shaped grooves 58 defined by a pair of inclined surfaces and which are particularly constructed and arranged to receive a noise portion 60 extending laterally outwardly from the end of a side flange portion 62 opposite the side flange portion 56. The side leg portions 48 define a window moving structure channel 49 therebetween.

Referring now more particularly to the guide rail member 18, it can be seen that it includes a longitudinally extending base portion 66, and that the side flange portions 56 and 62 extend outwardly from opposite transverse ends of the base portion 66 to define a guide rail channel 82 therebetween. The side flange portion 62 initially extends from the base portion 66 in a generally perpendicular relation to the base portion 66. The nose portion 60 of the side flange portion 62 is a folded over end portion and includes a longitudinal strip of metal 68 extending laterally outwardly away from the guide rail channel 82 formed by the steel guide rail member 18, a rounded end region 70, and a longitudinally extending flat portion 72 disposed in overlying relation with respect to the strip 68. The exterior surface provided by the rounded portion 70 has a generally rounded exterior surface 74 which is received within the "V"-shaped nose-receiving grooves 58 in the side leg portions 48 adjacent thereto. It can be appreciated from FIG. 3 that the "V" shaped groove 58 forms a relatively acute angle, and that the more oblique or rounded exterior surface 74 of the arcuate portion 70 of nose portion 60 does not engage the vertex of the angled groove 58. Rather, the rounded surface 74 engages the relatively flat inclined surfaces on opposite sides of the vertex for groove 58.

Figure 5:
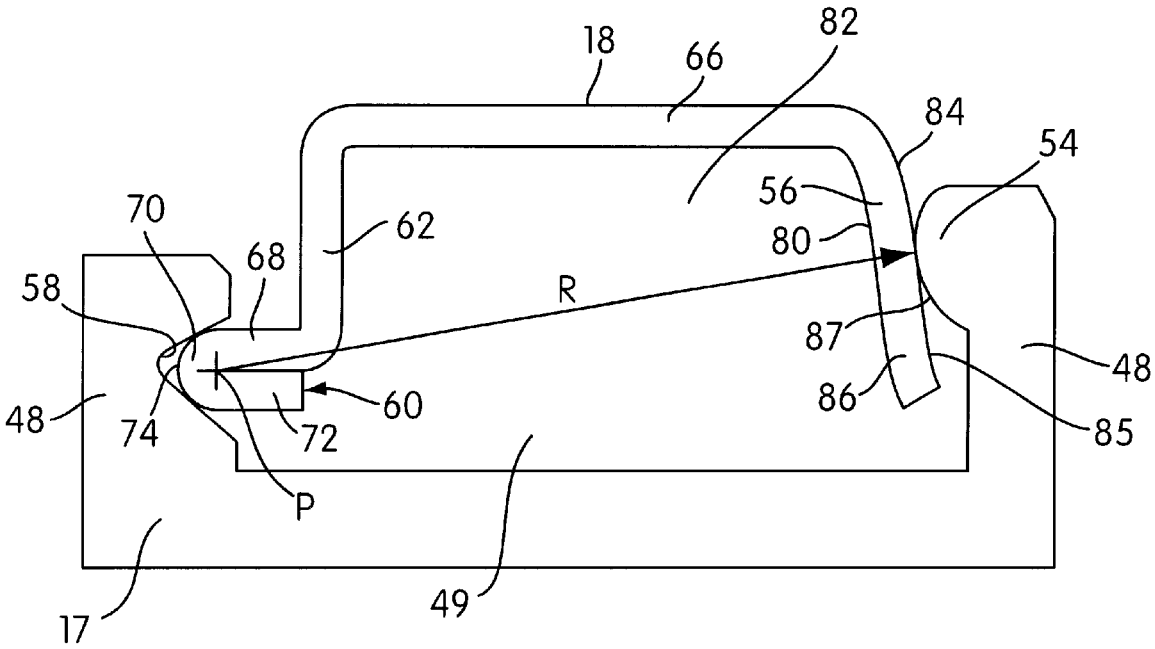
FIG. 5 is a cross-sectional view of the wedge slider member and rail channel in accordance with the present invention.

The opposite side flange 56 has somewhat of a curved or arcuate convex configuration as it extends outwardly from base portion 66. In particular, as shown in FIG. 3, the side flange portion 56 has a generally concave lower interior surface 80 facing the channel 82 defined by the guide rail member 18, and a generally convex exterior surface 84 which slidably engages the inwardly facing surfaces 87 of the projecting portions 54 of the respective leg portions 48. As can be appreciated from arrow R in FIG. 5, the center of curvature of the convex exterior surface 84 originates or coincides with the center of curvature of the nose portion 70 of the opposite folded flange portion 60 as shown. In other words the convex exterior surface 84 is defined by an arc segment of an imaginary circle having a centerpoint coinciding with the pivot axis P extending through the nose longitudinally portion which will be discussed below in further detail.

Figure 6:
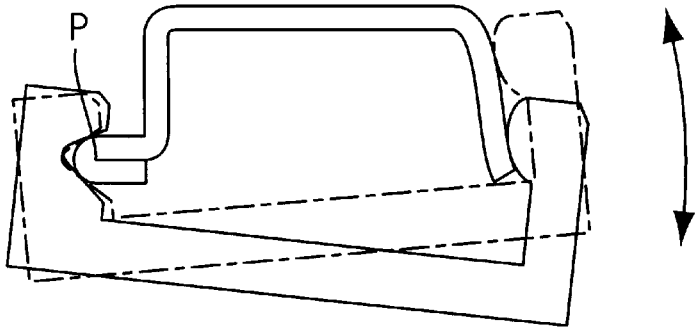
FIG. 6 is a cross-sectional view similar to that of FIG. 5, but showing the tilting or rotational capabilities of the slider member relative to the rail member.

The end portion 86 of the side flange portion 56 is bent slightly outwardly in an opposite direction from the more proximal portions of the side flange portion 56 in a direction slightly away from the channel 82 to provide a concave exterior surface 85 adjacent the convex exterior surface 84. As a whole, the side flange portion 56 has a slight "S" shaped configuration as viewed in the position shown in FIG. 3 (inverted "S" in FIGS. 5 and 6).

The projecting portions 54 of the respective leg portions 48 have an inwardly facing surface 87 which engages the lower convex exterior surface 84 of the side flange 56. Inwardly facing surface 87 is provided with an arcuate or rounded configuration. The design in accordance with the present invention permits freedom of rotation of the slider member 17 (and the components mounted thereto) about a fixed axis running longitudinally along the guide rail member 18, generally about a fixed pivot axis P as shown, which is the aforementioned center of curvature of the convex exterior surface 84 of side flange 56 (see FIG. 6). The slider member 17 pivots about fixed pivot axis P by permitting the exterior curved surface 87 of the projecting portions 54 to move in sliding engagement about the circular path defined by the exterior convex surface 84. In addition, the "V"-shaped groove 58 permits the curved exterior surface 74 of the folded flange portion 60 to be rotatably received therein and pivot about the pivot axis P.

The concave exterior surface 85 is configured to engage the inwardly facing surfaces 87 of the projecting portions 54 in order to prevent the side leg portion 48 and the side flange portion 56 from moving out of engagement with one another. This function is usually not necessary when the mechanism is installed with the vehicle door, but it is desirable during shipping of the mechanism. Such an arrangement prevents the slider member 17 from becoming separated from the guide rail member 18 and increases assembly efficiency by eliminating the time spent finding and putting together separated components.

It should be appreciated that there is a small interference in the fit between the slider contact surfaces and the guide rail member 18, thereby providing a chuck-free assembly. The stiffness of the legs 48 which form the "V" shaped grooves are fine-tuned to provide the right amount of resistance to deformation under window tipping forces while at the same time having low friction and wear characteristics. The stiffness can be altered by changing the sizes, the material, or by use of stiffening members.

In an alternate embodiment, the slider member 17 can be molded together with the lifter plate 16 as an integral window moving structure, incorporating the nipple housing 34 to which the wires W1 and W2 attach.

The design in accordance with the present invention permits freedom of rotation of the slider member 17 about the pivot axis P to allow for the spiraling action of the rails which are mounted at an angle to the vertical, as can be achieved in other conventionally provided slider/rail designs. In addition, the inboard/outboard freedom is eliminated by the "V"-shaped groove configuration in conjunction with the curved opposite wall of the guide rail member 18 as can be appreciated from the figures. In other words, the relative movement between the guide rail member 18 and the slider member 17 in a radial direction with respect to the pivot axis is substantially prevented.

The advantages of such a construction are two-fold. First of all, the relative pivoting movement of the slider member 17 with respect to the fixed pivot axis P of the guide rail member 18 allows for limited pivotal free play in order to compensate for any irregularities or misalignments which may occur during the machining of the components, installation of the mechanism, or which simply may develop over a period of usage. Second, the construction limits radial movement of the slider member 17 with respect to the guide rail member 18. By limiting such radial movement, vibrations and resultant vibratory noises which occur when the vehicle door is forcibly moved into closing engagement with the vehicle body are minimized or eliminated because free play in directions other than the pivoting movement allowed about pivot axis P has been prevented.

In a preferred embodiment, the guide rail member 18 is formed in a roll-forming operation. The guide rail member can initially be formed with a symmetric cross-section, and then formed into the provided shape with curving tools and post-forming operations.

In accordance with the present invention, the slider member leg portions 48 need not be resiliently biased inwardly against the side flange portions 56 or 62 to maintain proper engagement. An interference fit without high frictional forces achieved, with zero clearance between the slide member 17 and the guide rail member 18 so as to prevent free play. At the same time, there is a low degree of friction between the slider member 17 and the guide rail member 18 to permit relatively easy movement of the slider member 17 along the guide rail member 18. Resiliently biasing the leg portions 48 against the side flange portions 56, however, is preferred because this allows the slider member 17 to be snap-fit of an intermediate portion of the guide rail member 18 rather than sliding it over an end portion thereof. This allows both ends of the guide rail member 18 to be constructed without regard to whether the slider member 17 will later have to be slid over one of the ends. The use of the term snap-fit encompasses the arrangement wherein the window moving structure is slidably mounted on an intermediate portion of the guide rail member by initially engaging the side leg portions with intermediate portions of the side flange portions so that the side leg portions are urged laterally outwardly until the nose-receiving groove reaches the nose portion and the inwardly facing surface of the another side leg portion opposite the nose-receiving groove reaches the convex exterior surface. The side leg portions resiliently move inwardly into engagement with the nose portion and the convex exterior surface to thereby realize a snap-fit engagement.

The above-described construction of the guide rail member 18 and the slider member 17 is also disclosed in a co-pending nonprovisional application entitled "Window Regulator Mechansim" invented by Peter J. Smith, also the inventor of the present application, being filed even date herewith (attorney DKT No. 292 REG 1) and being incorporated into the present application by reference thereto. Both the present application and the above-mentioned application of Smith claim priority from a common U.S. Provisional Application Ser. No. 60/045,698, the entirety of which is incorporated herein by reference.

Figure 7:
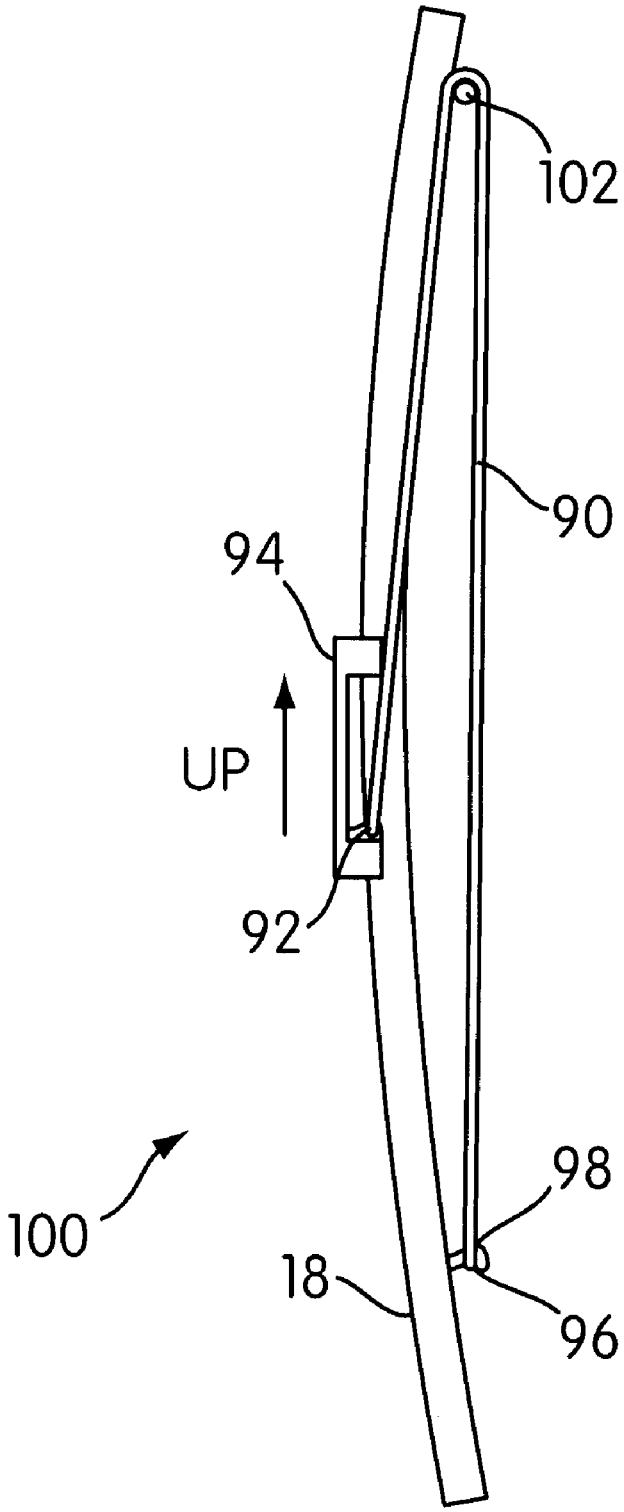
FIG. 7 is a schematic side plan view showing a motor vehicle window counterbalance assembly with certain components removed in order to more clearly show its construction.

A counterbalance assembly for a motor vehicle window is shown generally at 100 in FIG. 7. The counterbalance assembly 100 can also be seen in FIG. 1. As shown, the assembly 100 includes an elongated, flexible counterbalancing member in the form of an elastic strap 90 connected at a first end 92 thereof to either one of the lifter plate 16 or slider member 17. For convenience, the combination of the lifter plate 16 and slider member 17 is referred to as a window moving structure and indicated by a single reference numeral 94. The opposite second end 98 of the elastic strap 90 is secured or fastened to a hook member 96 located within the motor vehicle door. Preferably, the hook member is rigidly secured to the guide rail member 18 at a lower portion on the inboard side thereof (see FIG. 1).

An intermediate portion of the elastic strap 90 extends over a guiding portion in the form of a rotatable roller or pulley member 102. The pulley or roller member 102 is rotatably mounted on a central pin or hub member (not shown) which is rigidly fixed to an upper portion of the guide rail member 18. The location of the pulley or roller member 102 is disposed above the uppermost position of the window moving structure 94, thereby allowing portions of the elastic strap 90 to extend downwardly to the fixedly attached ends thereof throughout all movements of the window moving structure 94.

The elastic strap 90 is tensioned between the hook 96 and the window moving structure 94 to apply a substantially constant upward counterbalancing force to the window moving structure 94 and hence the window panel 12 fixed thereto (not shown in FIG. 7). When the window moving structure 94 is in its uppermost position, the strap 90 is in its initial elastically deformed state.

The counterbalancing assembly 100 is used to facilitate opening and closing of the window panel 12. In particular, the elastic strap 90 resiliently returns to its initial elastically deformed state and applies an upward counterbalancing force to the window moving structure 12 as it moves from its lowermost or window-lowered position to its uppermost position in order counterbalance the downwardly directed forces applied by gravity acting on the relatively heavy window glass 12 and facilitate upward movement of the window panel 12 towards its closed or raised position. In addition, the elastic strap 90 elastically deforms beyond its initial elastically deformed state and applies a certain degree of resistance in the form of the upwardly directed counterbalancing force against the downwardly directed force of gravity as the window moving structure moves from its uppermost to its lowermost position in order to provide a controlled downward movement of the speed of window panel 12.

The utilization of such a counterbalancing force is particularly useful in window regulators which are actuated by use of a manually engaged crank handle 40. The counterbalancing force assists the manual application of torque to the crank handle 40 in a window raising rotational direction which effects upward movement of the window 12 towards the closed position. It also helps control the downward speed of the window panel 12 and maintains a smooth manual application of torque movement for the user as he rotates the crank handle 40 in a window lowering rotational direction to lower the window. Preferably, the amount of torque applied to crank handle 40 needed for raising and lowering the window will be approximately the same.

The elastic strap 90 resists aging for a time suitable to provide a useful product life span. The elastic strap 90 should also exhibit high extension capabilities, high fatigue resistance, and should also resist the effects of grease and salt as much as possible. In addition, the elastic strap 90 also remains flexible at low temperatures.

The strap 90 can be manufactured using any conventional resilient elastomeric material. Neoprene is one preferred material, although this material has limited flexibility at low temperatures. Neoprene is a preferred material at temperatures above −45° C. Mypalon, Nitril (Buna-N), and EPDM are also preferred materials.

In the preferred embodiment, the strap 90 is made from EPDM and has a uniform cross-section throughout most of its length. A loop is provided at each end 98 and 92 thereof for connection with the hook 96 and window moving structure 94, respectively. The preferred cross sectional configuration is somewhat of an oval configuration, approximately 10 mm by about 3 mm. The preferred length of the EPDM strap in its non-deformed state (not installed) is about 300 mm. This length of strap can be installed successfully in most vehicles. The length of the 300 mm EPDM strap when the window moving structure 94 is in its uppermost position and the strap 90 is in its initial elastically deformed state is typically about 450 mm and it exhibits an upwardly directed counterbalancing force on the window moving structure 94 of about 6–12N. The preferred length of the EPDM strap when the window moving structure 94 is in its lowermost position is typically about 950 mm and it applies an upwardly directed counterbalancing force on the window moving structure of about 35–40N.

It should be appreciated that the applied forces can easily and finely tuned by changing materials and dimensions of the strap 90. It is also desirable that the force exerted by the strap 90 on the lifter plate 16 in the uppermost position of the window moving structure 94 should be as close as possible to the force exerted at its lowermost position. This can be achieved by using an elastomeric material which has a fairly low stiffness and by making the minimum installed strap into the full up position.

The preferred embodiment of the strap is uncoated but it is within the scope of this invention to coat the strap if conditions warrant to reduce friction with the pulley 102. In fact, the present invention contemplates that a coated strap need not be used in conjunction with a rotatable guide pulley, but can be used in conjunction with a non-rotatable pin. The non-rotatable pin itself can be coated with a friction reducing material, such as plastic. However, if the frictional force between the strap and pin is too high, the rotatable guide pulley 102 should be used. In fact the rotatable guide pulley 102 can be made from a low friction plastic or coated therewith.

The counter balancing member of the present invention may be used with any guide rail member and window moving structure assembly. The pivotally movable assembly described in the present application is simply illustrative and intended to show the preferred embodiment. The use of the counterbalancing member is not intended to be limited to the guide rail member and window moving structure assembly described herein.

The window counter balance assembly of the present invention employs an elastic strap member that is intended to replace conventional steel counter balance springs. The construction of the present invention is less expensive and offers greater flexibility for operation with variations in window design in comparison with the conventional construction.

While the invention has been described in connection with what is presently considered to be the most practical and preferred embodiment, it is understood that the invention is not limited to the disclosed embodiments but, on the contrary, is intended to cover various modifications and equivalent arrangements included within the spirit and scope of the appended claims.

What is claimed is:

1. A window regulator mechanism adapted for generally vertically moving a window panel mounted within a motor vehicle door, said mechanism comprising:

an elongated guide rail member adapted to be mounted within the vehicle door and extending longitudinally in a generally vertical direction, a window moving structure adapted to engage the window panel, said window moving structure being slidably mounted on said guide rail member llow the window panel to be moved generally vertically with respect to the vehicle door;

an actuating mechanism constructed and arranged to slidably move said window moving structure along said guide rail member so that said window panel is moved generally vertically with respect to the vehicle door; and an elongated, flexible counterbalancing member constructed and arranged to apply a counterbalancing force to the window panel that opposes a force of gravity acting on the window panel, said counterbalancing member having a first end adapted to be fixedly attached within the motor vehicle door, a second end fixedly attached to said window moving structure, and an intermediate portion extending over a guiding portion disposed above an uppermost position of said window moving structure so that portions of said counterbalancing member extend downwardly therefrom to said fixedly attached ends, said counterbalancing member being formed from a flexible elastomeric material and being elastically deformed to an initial elastically deformed state when said window moving structure is in its uppermost position, said counterbalancing member being configured to elastically deform beyond its initial elastically deformed state as the window panel moves downwardly with respect to the vehicle door against the counterbalancing force of the counterbalancing member to thereby oppose the force of gravity acting on the window panel and thereby provide a controlled, downward movement of the window panel, said counterbalancing member resiliently returning to its initial elastically deformed state as the window panel moves upwardly with respect to the vehicle door, said counterbalancing member applying said counterbalancing force to oppose the force of gravity acting on the window panel as the window panel moves upwardly to thereby facilitate upward movement of the window panel.

2. A window regulator mechanism according to claim 1, wherein said actuating mechanism comprises:

a crank handle adapted to be mounted on an inboard portion of the vehicle door, said crank handle being constructed and arranged such that application of torque movement to said crank handle in a window raising rotational direction moves the window panel vertically upward with respect to the vehicle door and application of torque movement to said crank handle in a window lowering rotational direction moves the window panel vertically downwardly with respect to the vehicle door.

3. A window regulator mechanism according to claim 2, wherein said actuating mechanism further comprises:

a first wire attached to said window moving structure and extending upwardly therefrom; and a second wire attached to said window moving structure and extending downwardly therefrom, said first and second wires being engaged with guiding portions disposed in spaced vertical relation to one another on said guide rail member, said first and second wires being wound over a driven drum connected with said crank handle so that rotation of said crank handle in the window raising rotational direction retracts said first wire and moves the window panel upward with respect to the vehicle door and rotation of said crank handle in the window lowering rotational direction retracts said second wire and moves the window panel downward with respect to the vehicle door.

4. A window regulator mechanism according to claim 1, wherein said counterbalancing member applies a counterbalancing force in the range of 6–12N when said window moving structure is in the uppermost position thereof, said counterbalancing member applying a counterbalancing force in the range of 35–40N when said window moving structure is in the lowermost position thereof.

5. A window regulator mechanism according to claim 1, wherein said counterbalancing member is a flexible elastic strap.

6. A window regulator mechanism according to claim 5, wherein said one end of said counterbalancing member adapted to be fixedly attached within the vehicle door is an end of said strap adapted to be fixedly attached, to said guide rail member.

7. A window regulator mechanism according to claim 5, wherein said strap comprises rubber.

8. A window regulator mechanism according to claim 7, wherein said rubber comprises neoprene.

9. A window regulator mechanism according to claim 7, wherein said guide portion is a rotatable pulley.

10. A window regulator mechanism according to claim 9, wherein said rotatable pulley is disposed on said guide rail member.

11. A window regulator mechanism according to claim 5, wherein said strap is made from EPDM.

12. A window regulator mechanism according to claim 11, wherein an undeformed length of said EPDM strap is 300 mm.

13. A window regulator mechanism according to claim 5, wherein said strap is made from Nitril.

14. A window regulator mechanism according to claim 5, wherein said strap is made from Mypalon.

15. A window regulator mechanism according to claim 1, wherein said guide portion is a rotatable pulley.

16. A window regulator mechanism according to claim 15, wherein said rotatable pulley is mounted on said guide rail member.

17. A window regulator mechanism according to claim 1, wherein said guiding portion is a non-rotatable glide pin extending laterally outwardly from said guide rail member.

* * * * *